US005213405A

United States Patent [19]

Giglia

[11] Patent Number: 5,213,405

[45] Date of Patent: May 25, 1993

[54] LIGHTSTICK WITH LINE ATTACHMENT MEANS

[75] Inventor: Robert D. Giglia, Rye, N.Y.

[73] Assignee: American Cyanamid Company, Stamford, Conn.

[21] Appl. No.: 796,972

[22] Filed: Nov. 25, 1991

Related U.S. Application Data

[63] Continuation-in-part of Ser. No. 759,345, Sep. 13, 1991, abandoned.

[51] Int. Cl.[5] ..... F21K 2/00

[52] U.S. Cl. ..... 362/34; 362/391; 362/396; 43/17.5

[58] Field of Search ..... 362/34, 84, 368, 389, 362/391, 396, 416, 417, 249, 457, 458; 248/231.8; 43/17.5, 17.6

[56] References Cited

U.S. PATENT DOCUMENTS

| | | | |
|---|---|---|---|
| 1,895,656 | 1/1933 | Gadke | 362/396 |
| 2,123,231 | 7/1938 | Clemence | 362/396 |
| 2,599,303 | 6/1952 | Ward | 362/396 |
| 3,290,017 | 12/1965 | Davies et al. | 206/221 |
| 3,863,380 | 2/1975 | Purlia | 43/17.6 |
| 3,900,728 | 8/1975 | Holcombe | 362/34 |
| 5,043,851 | 8/1991 | Kaplan | 362/396 |
| 5,067,061 | 11/1991 | Ladyjensky | 362/34 |

*Primary Examiner*—Stephen F. Husar
*Attorney, Agent, or Firm*—Frank M. Van Riet

[57] ABSTRACT

A line attachment means for use on a lightstick is disclosed whereby the lightstick can be easily attached to a line such as for fishing and easily removed after use.

10 Claims, 2 Drawing Sheets

LIGHTSTICK WITH LINE ATTACHMENT MEANS

CROSS-REFERENCE TO RELATED APPLICATION

This application is a continuation-in-part of copending U.S. application Ser. No. 07/759,345 filed Sep. 13, 1991, now abandoned.

BACKGROUND OF THE INVENTION

Chemical lightsticks have been manufactured and sold for many years as novelty items, safety devices and generally for use anywhere an electrically created light is not possible or feasible. One use for lightsticks that has increased over the years is in the area of commercial and recreational fishing. The light generated by the lightstick under the water is an attraction to fish and yields have increased significantly when they are used.

One of the major drawbacks in the use of chemical lightsticks as fishing lures is the time that is spent attaching and removing the lightsticks from the monofilament line to which the hook is attached. In the past, lightsticks have been attached to the line via the use of string or rubber bands and removal of the lightsticks from the line when using such attachment means has been particularly difficult and time consuming. Furthermore, string and/or rubber bands have not proven to be particularly reusable and must be replaced when a semi-extinguished lightstick is being employed. It has also been observed that lightsticks are lost during use due to string or rubber band breakage and that such attachment means often fail because the lightstick has a tendency to move up and away from the hook due to its buoyancy.

Accordingly, if a means could be found for attaching lightsticks to a linear line for use in fishing or for hanging e.g. such as for party lights, a long felt need would be satisfied.

SUMMARY OF THE INVENTION

A device is provided for attaching a chemical lightstick to a linear line, said device constituting cantilever arms which exert forces which enable the device to engage and hold onto the line.

THE DRAWINGS

DESCRIPTION OF THE INVENTION INCLUDING PREFERRED EMBODIMENT

Figure 1:
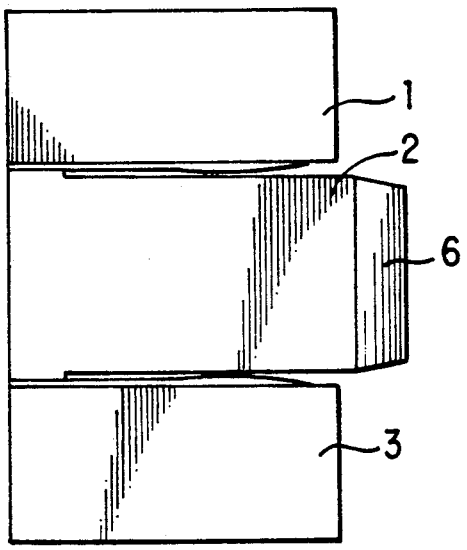
FIG. 1 is a top view of the attaching device showing the cantilever arms.

The invention relates to a line attaching device comprising three cantilever arms attached to a singular beam, said arms being positioned in serial relationship along said beam, the first and third arms being in one plane and the second arm being in a different parallel plane, said first and third arms each having a line-retaining projection facing the interior face of the third arm, each of said arms having a beveled exterior end, the bevel of the first and third arms being about ninety degrees to that of the second arm.

Also within the scope of the present invention is a chemical light device comprising a first section containing at least two (2) compartments each of which contains a chemical composition which when mixed with the other results in the production of chemical light and each of which is physically separated from the other such as to prevent said compositions from mixing until required by a means capable of allowing said admixing and a section which is adapted to engage and hold a line or linear line via forces exerted by opposed cantilever arms. Preferably, the second section comprises the attaching device described above.

Even more preferably, the first section comprises an elongated tube which is sealed at each end and which has within its interior area a disk or diaphragm having approximately a circular shape and a cross-section approximately rectangular in profile positioned transversely with respect to the tube's axis, said disk or diaphragm having its periphery in continuous contact with the interior of the tube wall, the external and internal diameters of said tube and the diameter of the disk or diaphragm being such that the diaphragm or disk can be tilted by pressure against the external wall of the tube so as to impart a tilting torque on the diaphragm or disk and thereby reposition it substantially parallel with respect to the compartments and allow the liquids therein to mix.

Most preferably, the first section comprises the above-described disk or diaphragm containing tube and the second section comprises the attaching device first described above.

The disk or diaphragm containing tube lightstick in more fully described in copending U.S. application Ser. No. 07/542,138 filed Jun. 22, 1990, now U.S. Pat. No. 5,067,051 which application is hereby incorporated herein by reference. U.S. Pat. No. 3,290,017 is also of interest.

The attaching device discussed above which may comprise the second section of the novel lightsticks hereof is preferably constructed of a material different from that material of which the first section is constructed. The material of the second section should possess a tensile strength higher than the first section material. Generally, the first section should be constructed of a material having a stiffness modulus (ASTM TEST METHOD D-790) of less than about 700 mPa, preferably less than about 655 mPa and a tensile yield strength (ASTM TEST METHOD D-638—TYPE IV SPECIMEN) greater than about 18 mPa. Polyolefins such as DuPont SCLAIR® 8405 which is a linear polyethylene and possesses this balance of modulus and strength may be used.

Figure 3:
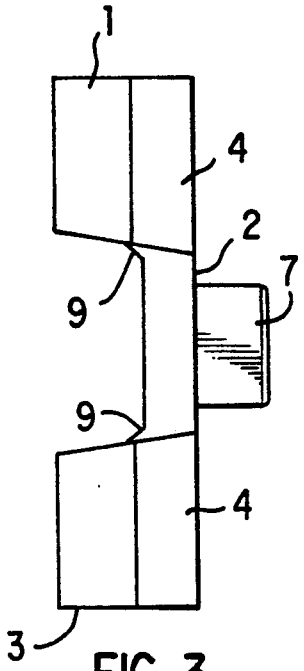
FIG. 3 is a front view of the attaching device specifically showing a means of affixing the device to a lightstick.

The instant invention may be better understood by reference to the drawings attached hereto wherein FIG. 1 is a top view of the attaching device and is comprised of outside arms 1 and 3 and interior arm 2. All three arms are serially attached to beam 4 best seen in FIG. 2. Each of the arms possesses a beveled interior edge 6 and arms and 1 and 3 are in a parallel plane different from that of arm 2 as best seen in FIG. 3. The beveled edges 6 of the arms are such that the bevel of arms 1 and 3 is substantially perpendicular to that of arm 2 i.e. they form about a 90° angle therewith. Protuberance 5 on arms 1 and 3 is constructed such as to receive and hold a line within the vacancy formed between the back edges of the arms, shown as 8 in FIG. 2.

Figure 4:
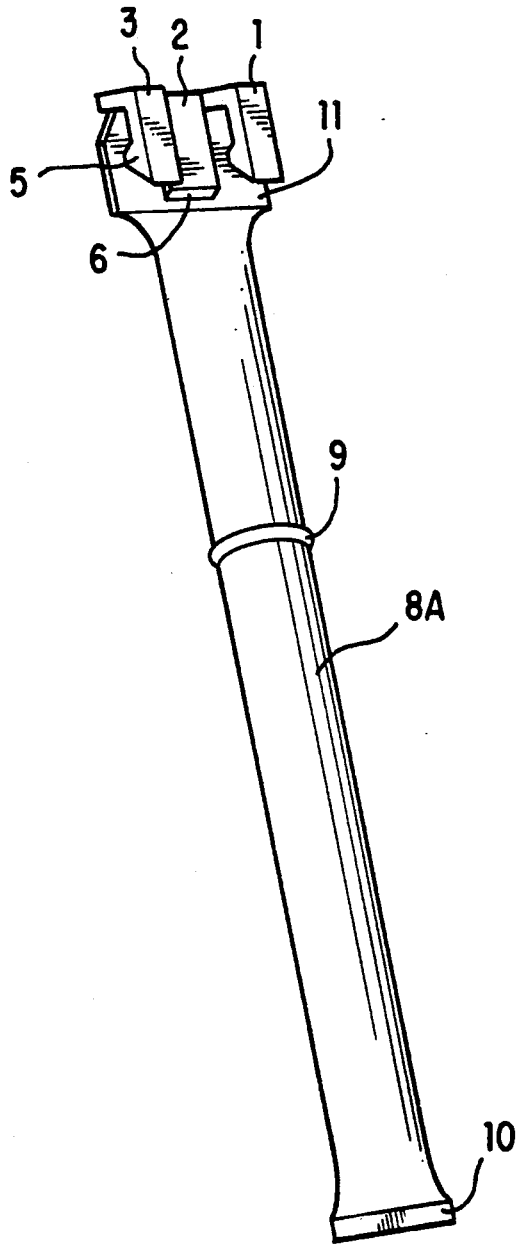
FIG. 4 is a perspective view of a lightstick having affixed thereto the attaching device of FIGS. 1-3.

The interior edges of the protuberances 5 preferably are also beveled. Affixing means 7 is positioned on the rear face of arm 2 so as to enable it to be positioned at the end of a lightstick as shown in FIG. 4. Means 7 may be rotatably positioned on the lightstick 8A at its flattened and sealed end 11 such as by sonic welding or force fitting it through a hole in end 11. Sealed end 10 prevents leakage of liquid from the compartment formed by disk or diaphragm 9. In a preferred embodiment, projections 9 may be positioned along the interior edges of arms 1,2 or 3, or all of them. These projections help maintain the position of the device on the line on which it is placed.

Figure 2:
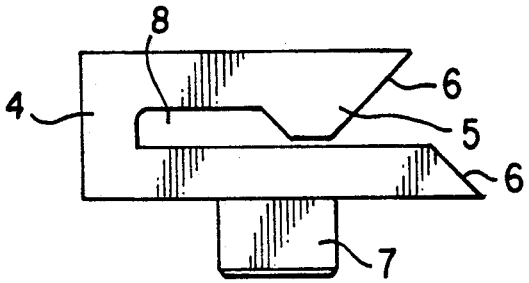
FIG. 2 is a side view of the attaching device showing the line-engaging protuberances.

In use, the lightstick is attached to a fishing line (or other line such as a string strung between affixed points at a party etc. by placing the line in the area of bevels 6 and forcibly pulling the device so as to cause the line to be positioned within area 8 of FIG. 2. The opposed cantilever forces of the arms maintain the line in area 8 and prevent the lightstick from moving along the line. Removal of the lightstick from the line is easily effected by merely pushing the attaching means off the line.

Figure 5:
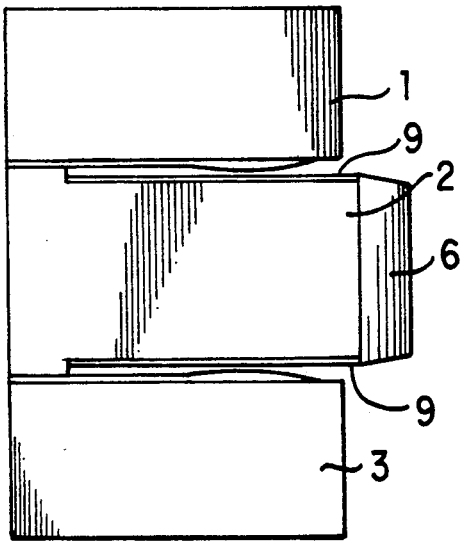

As indicated above, the friction between the attaching device and the line may be increased by adding protuberances 9 along the edges of the arms as best shown in FIG. 5.

We claim:

1. A chemical light device comprising a first section containing at least two compartments each of which contains a chemical composition which when admixed results in production of chemical light and each of which is physically separated from one another such as to prevent said compositions from admixing until required by a means capable of allowing said admixing and a second section which is adapted to engage and hold a linear line via forces exerted by first, second and third cantilever arms the first and third arms being in one plane and the second arm being in a different plane.

2. A device according to claim 1 wherein said second section is made from a material having a tensile strength higher than the material from which the first section is made.

3. A device according to claim 1 wherein said second section comprises first, second and third cantilever arms attached to a singular beam and being positioned in serial relationship along said beam, the first and third arms being in one plane and the second arm being in a different plane, said first, second and third arms each having an interior line-retaining projection, the projection of the first and third arms facing the interior of said second arm, each of said arms having beveled exterior ends, the level of the first and third arms being ninety degrees to that of said second arm, said second section being attached to said first section via said second arm.

4. A device according to claim 1 wherein said first section comprises an elongated tube having a wall possessing an interior and an exterior side and an interior and exterior diameter which is sealed at each end and which has within its interior area a disk or diaphragm having approximately a circular shape and a cross-section approximately rectangular in profile positioned transversely with respect to the longitudinal axis of the tube, said disk or diaphragm having its periphery in continuous contact with the interior side of the tube wall, the external and internal diameters of said tube and the diameter of the diaphragm or disk being such that the diaphragm or disk can be tilted by pressure against the external side of the wall of the tube so as to impart a tilting torque on the disk or diaphragm and reposition it substantially parallel with respect to the longitudinal axis of the tube to thereby connect said compartments and allow the compositions therein to mix.

5. A device according to claim 3 wherein said first section comprises an elongated tube having a wall possessing an interior and an exterior side and an interior and exterior diameter, which is sealed at each end and which has within its interior area a disk or diaphragm having approximately a circular shape and a cross-section approximately rectangular in profile positioned transversely with respect to the longitudinal axis of the tube, said disk or diaphragm having its periphery in continuous contact with the interior side of the tube wall, the external and internal diameters of said tube and the diameter of the diaphragm or disk being such that the diaphragm or disk can be tilted by pressure against the external side of the wall of the tube so as to impart a tilting torque on the disk or diaphragm and reposition it substantially parallel with respect to the longitudinal axis of the tube to thereby connect said compartments and allow the compositions therein to mix.

6. A device according to claim 3 wherein at least one of said arms has edge protuberances.

7. A device according to claim 3 wherein all of said arms have edge protuberances.

8. A line attaching device comprising first, second and third cantilever arms attached to a singular beam, and being positioned in serial relationship along said beam, the first and third arms being in one plane and the second arm being in a different parallel plane, said first, second and third arms each having an interior line-retaining projection, the projection of the first and third arms facing the interior of said second arm, each of said arms having beveled exterior ends, the bevel of the first and third arms being ninety degrees to that of said second arm.

9. A line attaching device according to claim 8 wherein at least one of said arms has edge protuberances.

10. A line attaching device according to claim 8 wherein all of said arms have edge protuberances.

* * * * *